US012419366B2

(12) United States Patent
Murphy

(10) Patent No.: US 12,419,366 B2
(45) Date of Patent: Sep. 23, 2025

(54) MODEST SWIMSUIT SYSTEM

(71) Applicant: Nike, Inc., Beaverton, OR (US)

(72) Inventor: Tracy Meagher Murphy, Miami, FL (US)

(73) Assignee: NIKE, Inc., Beaverton, OR (US)

( * ) Notice: Subject to any disclaimer, the term of this patent is extended or adjusted under 35 U.S.C. 154(b) by 8 days.

(21) Appl. No.: 18/029,049

(22) PCT Filed: Sep. 28, 2020

(86) PCT No.: PCT/US2020/053058
§ 371 (c)(1),
(2) Date: Mar. 28, 2023

(87) PCT Pub. No.: WO2022/066182
PCT Pub. Date: Mar. 31, 2022

(65) Prior Publication Data

US 2023/0371620 A1 Nov. 23, 2023

(51) Int. Cl.
*A41D 7/00* (2006.01)
*A41D 27/28* (2006.01)

(52) U.S. Cl.
CPC ..... *A41D 7/00* (2013.01); *A41D 27/28* (2013.01); *A41D 2200/20* (2013.01)

(58) Field of Classification Search
CPC ..... A41D 7/00; A41D 7/006; A41D 7/008; A41D 27/28; A41D 15/002
See application file for complete search history.

(56) References Cited

U.S. PATENT DOCUMENTS 391,006 A * 10/1888 Munsing ..... D04B 9/54 66/172 R
2,057,713 A * 10/1936 Edelson ..... A41D 27/28 2/87
2,084,173 A * 6/1937 Wexler ..... A41D 27/28 2/87

(Continued)

FOREIGN PATENT DOCUMENTS

FR 2912037 8/2008

OTHER PUBLICATIONS

Espacenet Translation of FR 2912037 (Year: 2008).*

(Continued)

*Primary Examiner* — Alissa L Hoey
(74) *Attorney, Agent, or Firm* — Shook, Hardy & Bacon L.L.P.

(57) ABSTRACT

Aspects herein are directed to full-coverage modest swimsuit system that includes features that improve performance and provide full range of motion without sacrificing modesty. In one example aspect, the swimsuit system includes an upper-body garment, a lower-body garment, and a head cover coupled to the upper-body garment. The upper-body garment includes extendable elastic cuffs at each wrist opening and at least one vent opening to provide improved water flow. The lower body garment includes an extendable elastic cuff at each ankle opening and at least one vent opening to provide improved water flow. The upper-body garment may further comprise an integrated bra for support. The head cover also includes a vent opening and a hair management pocket to hold hair in place.

17 Claims, 11 Drawing Sheets

(56) References Cited

U.S. PATENT DOCUMENTS 2,458,004 A * 1/1949 Kerr ..... A41D 3/00 2/93
2,560,598 A * 7/1951 Rinis ..... A41D 3/00 2/84
3,086,215 A * 4/1963 Di Paola ..... A41D 27/28 2/87
4,055,174 A * 10/1977 LeVasseur ..... A63B 31/08 128/201.27
4,944,041 A * 7/1990 Buenos ..... A41D 19/0041 2/84
4,956,878 A * 9/1990 Boynton ..... A41D 7/00 450/11
5,033,986 A * 7/1991 Feigenbaum ..... A41C 3/08 450/59
5,103,502 A * 4/1992 Grilliot ..... A62B 17/001 2/93
5,255,392 A * 10/1993 Stanislaw ..... A41D 27/208 2/403
5,421,032 A * 6/1995 Murphy ..... A41D 27/208 2/247
5,642,526 A * 7/1997 Thompson ..... A41D 13/02 2/DIG. 1
5,678,246 A * 10/1997 Cooley ..... A41D 7/00 2/69
5,784,720 A * 7/1998 Mellon ..... A41D 19/0041 2/60
5,794,265 A * 8/1998 Reich ..... A41D 19/0041 2/125
5,946,726 A * 9/1999 Green ..... A41C 3/08 2/102
6,059,633 A * 5/2000 Currier ..... A41C 3/08 450/11
6,443,805 B1 * 9/2002 Kirkwood ..... A41C 3/08 450/57
6,477,712 B1 * 11/2002 Jones ..... A41D 13/02 2/456
6,530,820 B1 * 3/2003 Katze ..... A41C 3/08 450/7
7,043,767 B2 * 5/2006 Jaeger ..... A41D 27/28 2/87
7,310,825 B2 * 12/2007 St-Germain ..... A41D 27/10 2/125
7,540,037 B1 * 6/2009 Bittler ..... A41D 27/28 2/69
8,321,964 B2 * 12/2012 Gernes ..... A41B 9/001 2/403
8,403,724 B1 * 3/2013 Chapin ..... A41C 3/08 450/32
8,690,634 B2 * 4/2014 Heath ..... A41C 3/0057 450/40
9,330,799 B1 * 5/2016 Phillips ..... G21F 3/02
9,364,038 B2 * 6/2016 Barrett ..... A42B 1/048
9,596,895 B2 * 3/2017 Meraz ..... A41D 13/02
9,763,482 B2 * 9/2017 Carcich ..... A41D 3/005
9,974,346 B2 * 5/2018 Beneyto-Ferre ..... A41D 31/18
9,974,347 B2 * 5/2018 Audet ..... A41D 27/28
10,098,395 B2 * 10/2018 Baschak ..... A41D 27/28
10,238,157 B2 * 3/2019 Nordstrom ..... A41D 31/145
10,244,804 B2 * 4/2019 Hodgson ..... A41D 27/28
10,349,687 B2 * 7/2019 Baschak ..... A41D 13/0015
10,433,594 B2 * 10/2019 Espili ..... A41D 13/02
10,595,569 B2 * 3/2020 Oguchi ..... A41C 3/144
10,687,572 B2 * 6/2020 Baker ..... A41D 31/14
11,185,115 B2 * 11/2021 Fahey ..... A41D 15/00
11,388,937 B2 * 7/2022 Nachawati ..... A63B 71/10
11,425,947 B2 * 8/2022 Hiney ..... A41D 27/28
11,606,993 B2 * 3/2023 Mattioni ..... A41D 31/145
11,638,453 B2 * 5/2023 Eckensweiler ..... A41D 15/002 2/125
11,700,896 B2 * 7/2023 Harris ..... A41D 31/10 2/126
11,805,831 B2 * 11/2023 Rafn ..... A41D 31/145
11,812,798 B2 * 11/2023 Blanton ..... A41D 1/02
11,910,848 B2 * 2/2024 Nachawati ..... A63B 71/10
11,944,135 B2 * 4/2024 Kerr ..... A41D 13/012
2006/0200890 A1 * 9/2006 Prat Gonzalez ..... A41D 13/02 2/69
2007/0118960 A1 * 5/2007 Goodwin ..... A41D 1/04 2/84
2008/0010723 A1 * 1/2008 Bingham ..... A41D 1/089 2/227
2008/0196140 A1 * 8/2008 Mayerson ..... A41D 1/04 2/84
2009/0025119 A1 * 1/2009 Nespor ..... A42B 1/049 2/202
2009/0178174 A1 * 7/2009 Cash, Jr. ..... A41D 27/28 2/243.1
2010/0170024 A1 * 7/2010 Seter ..... A42B 1/048 2/202
2011/0225699 A1 * 9/2011 Elhamsadat ..... A42B 1/048 2/84
2013/0247275 A1 * 9/2013 Javad ..... A42B 1/16 2/203
2015/0208747 A1 * 7/2015 Barrett ..... A42B 1/048 2/84
2015/0313302 A1 * 11/2015 Boyle ..... A41D 27/28 2/227
2016/0150847 A1 * 6/2016 Johnson ..... A42C 5/04 2/202
2017/0156425 A1 * 6/2017 Jeong ..... A41D 27/02
2017/0172237 A1 * 6/2017 Martin ..... A41D 27/201
2017/0290382 A1 * 10/2017 Arnold ..... A41D 13/0015
2017/0311655 A1 * 11/2017 Gonzalez ..... A41D 7/008
2018/0295900 A1 * 10/2018 Murphy ..... A41D 1/08
2019/0125008 A1 * 5/2019 King ..... A41D 7/008
2019/0297964 A1 * 10/2019 Brown ..... A45D 20/00
2021/0052022 A1 * 2/2021 George ..... A41D 27/24
2022/0273048 A1 * 9/2022 Morgan ..... A41D 7/00
2023/0329364 A1 * 10/2023 Rybak ..... A42B 1/048
2023/0337767 A1 * 10/2023 Cook ..... A41D 1/089
2024/0081432 A1 * 3/2024 Hudy ..... A41B 1/08
2024/0148085 A1 * 5/2024 Nachawati ..... A41D 1/22
2025/0000181 A1 * 1/2025 Graneto, III ..... A41D 15/002

OTHER PUBLICATIONS

Espacent Drawings of FR 2912037 (Year: 2008).*
International Preliminary Report on Patentability received for PCT Patent Application No. PCT/US2020/053058, mailed on Apr. 6, 2023, 7 pages.
International Search Report of PCT Application No. PCT/US2020/053058 Filed Sep. 28, 2020, 2 Pages.
Anonymous, Nike Victory Swim Collection Official Images and Release Date, Nike News 10 December (Dec. 10, 2019), https://news.nike.com/news/nike-victory-swim-collection-official-images-and-release-date, Mar. 28, 2023.
Office Action received for Canadian Patent Application No. 3193585, mailed on Jun. 17, 2024, 3 pages.
Office Action received for Canadian Patent Application No. 3193585, mailed on Apr. 30, 2025, 5 pages.

* cited by examiner

MODEST SWIMSUIT SYSTEM

FIELD OF THE INVENTION

Aspects herein are directed to a full-coverage, modest swimsuit system including an upper-body garment, a lower-body garment, and a head cover.

BACKGROUND OF THE INVENTION

Traditionally, female swimsuits have been designed for athletes to improve performance while competing. However, such swimsuits are generally not designed with modesty in mind and do not cover significant portions of a wearer's body. As such, females who prefer or require more modest swimsuits, such as those who might cover their head, legs, or arms, as a sign of modesty and/or a symbol of religious faith face challenges finding swimsuits that conform to modesty requirements without diminishing athletic performance.

SUMMARY OF THE INVENTION

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A swimsuit system comprising an upper-body garment having a torso portion defining a neck opening, a first long sleeve extending from the torso portion and having a first wrist opening, and a second long sleeve extending from the torso portion and having a second wrist opening, wherein the first wrist opening and the second wrist opening each include an extendable elastic cuff, and wherein the upper-body garment includes at least one vent opening at one or more of the first long sleeve and the second long sleeve; a head cover coupled to the neck opening of the upper-body garment; and a lower-body garment having a torso portion, a first leg portion extending from the torso portion and having a first ankle opening, and a second leg portion extending from the torso portion and having a second ankle opening, wherein the first ankle opening and the second ankle opening each include an extendable elastic cuff, and wherein the lower-body garment includes at least one vent opening located at one or more of a first knee area of the first leg portion and a second knee area of the second leg portion.

Clause 2. The swimsuit system according to clause 1, wherein the at least one vent opening includes a first vent opening located adjacent to where the first long sleeve extends from the torso portion and a second vent opening located adjacent to where the second long sleeve extends from the torso portion.

Clause 3. The swimsuit system according to any of clauses 1 through 2, wherein the at least one vent opening further includes a third vent opening located adjacent to where the head cover is coupled to the neck opening.

Clause 4. The swimsuit system according to any of clauses 1 through 3, wherein the torso portion of the upper-body garment includes a mesh layer located interior to an outer layer.

Clause 5. The swimsuit garment according to any of clauses 1 through 4, further comprising a bra having a front side, a back side, and a pair of shoulder straps that extend from the front side and that are affixed adjacent to the neck opening of the upper-body garment.

Clause 6. The swimsuit system according to any of clauses 1 through 5, wherein the head cover comprises a panel of material having a perimeter edge that is affixed to an inner surface of the head cover at a back side of the head cover, the panel of material having a vertically oriented opening configured to receive hair of a wearer.

Clause 7. The swimsuit system according to any of clauses 1 through 6, wherein the extendable elastic cuff of the first wrist opening and the second wrist opening includes a thumb-receiving hole.

Clause 8. The swimsuit system according to any of clauses 1 through 7, wherein the extendable elastic cuff of the first ankle opening and the second ankle opening are configured to extend at least partially over an instep area and a sole of a wearer when the lower-body garment is in an as-worn configuration.

Clause 9. The swimsuit system according to any of clauses 1 through 8, wherein the at least one vent opening on the upper-body garment and the at least one vent opening on the lower-body garment include a mesh insert that extends across the respective vent opening.

Clause 10. A swimsuit system comprising: an upper-body garment having a torso portion defining a neck opening, a first long sleeve extending from a first sleeve opening of the torso portion and having a first wrist opening, and a second long sleeve extending from a second sleeve opening of the torso portion and having a second wrist opening, wherein the first wrist opening and the second wrist opening each include an extendable elastic cuff, and wherein the upper-body garment includes at least one vent opening at one or more of the neck opening, the first long sleeve, and the second long sleeve; a bra having a front side, a back side, and a pair of shoulder straps that extend from the front side and are affixed adjacent to the neck opening of the upper-body garment; and a head cover fixedly coupled to the neck opening of the upper-body garment.

Clause 11. The swimsuit system according to clause 10, further comprising a lower-body garment having a torso portion, a first leg portion extending from the torso portion and having a first ankle opening, and a second leg portion extending from the torso portion and having a second ankle opening, wherein the first ankle opening and the second ankle opening each include an extendable elastic cuff, and wherein the lower-body garment includes at least one vent opening located at one or more of a first knee area of the first leg portion and a second knee area of the second leg portion.

Clause 12. The swimsuit system according to clause 11, wherein the extendable elastic cuff of the first wrist opening and the second wrist opening and the extendable elastic cuff of the first ankle opening and the second ankle opening are constructed from a jersey knit fabric.

Clause 13. The swimsuit system according to any of clauses 11 through 12, wherein the lower-body garment further comprises a waistband, and wherein the waistband includes a pocket located on a back side of the waistband.

Clause 14. The swimsuit system according to any of clauses 10 through 13, wherein the at least one vent opening includes a first vent opening located adjacent to where the first long sleeve extends from the torso portion and a second vent opening located adjacent to where the second long sleeve extends from the torso portion.

Clause 15. The swimsuit system according to any of clauses 10 through 14, wherein the head cover comprises a panel of material having a perimeter edge that is affixed to an inner surface of the head cover at a back side of the head cover, the panel of material having a vertically oriented opening configured to receive hair of a wearer.

Clause 16. The swimsuit system according to any of clauses 10 through 15, wherein the extendable elastic cuff of the first wrist opening and the second wrist opening each includes a thumb-receiving hole.

Clause 17. The swimsuit system according to any of clauses 10 through 16, wherein the at least one vent opening includes a mesh insert that extends across the respective vent opening.

Clause 18. The swimsuit system according to any of clauses 10 through 17, wherein the back side of the bra is formed from a mesh panel that is affixed to the neck opening.

Clause 19. The swimsuit system according to clause 18, wherein remaining areas of the mesh panel are unaffixed from the upper-body garment.

Clause 20. A method of using the swimsuit system of claim 1 comprising: donning the swimsuit system.

BRIEF DESCRIPTION OF THE DRAWING

Examples of aspects herein are described in detail below with reference to the attached drawing figures, wherein.

DETAILED DESCRIPTION OF THE INVENTION

Figure 1A:
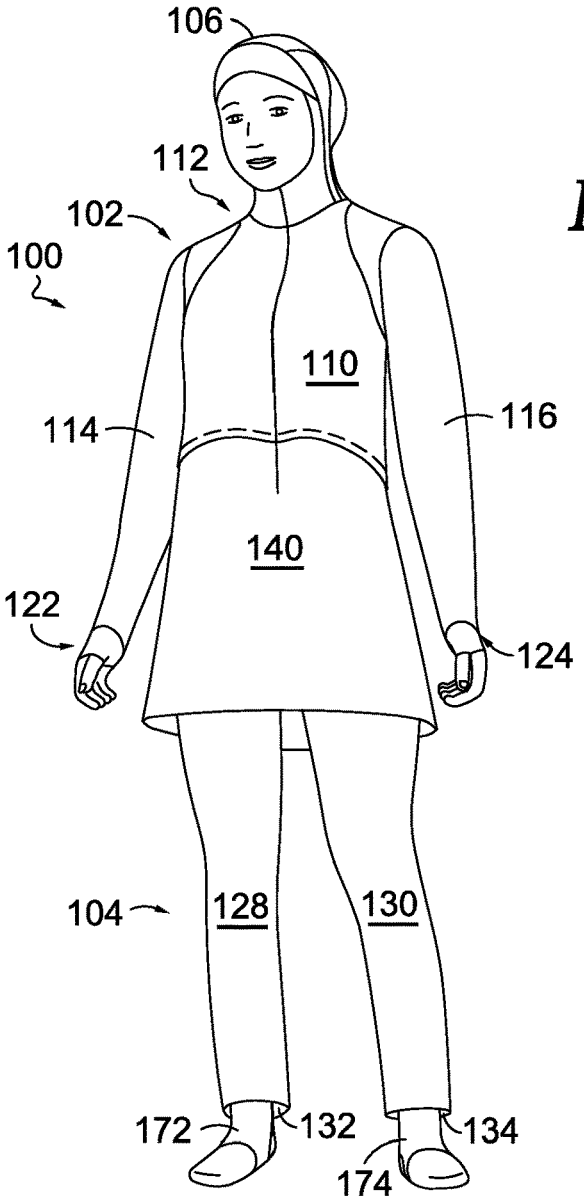
FIG. 1A illustrates a front view of an example swimsuit system comprising an upper-body garment, a lower-body garment, and a head cover in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional swimsuits for swimming and aquatic sports have generally not been designed with modesty in mind and do not provide many options for female athletes desiring or requiring more modest swimsuits. For example, traditional modest swimsuits may leave athletes feeling weighted down by baggy garments and battling drag, or worrying about whether coverings, such as hijabs, will remain in place. As such, there is a need for modest swimwear for females seeking full coverage without sacrificing full range of motion in the water and performance features such as an aerodynamic profile.

Aspects herein are directed to a full-coverage, modest swimsuit system including an upper-body garment, a lower-body garment, and a head cover affixed to the upper-body garment. The swimsuit system is configured to facilitate a wearer's range of motion in water, create an aerodynamic profile (i.e., reduce drag points), provide water outflow at specific locations, and includes features that help to maintain the swimsuit system in a generally fixed position on the wearer's body to preserve modesty. In one example aspect, the swimsuit system includes multiple vent openings strategically placed to allow water and/or air within the swimsuit system to exit the swimsuit system. The vent openings are strategically positioned at one more locations on the upper-body garment, the lower body garment, and the head cover. Extendable elastic cuffs located at the wrist openings and ankle openings help to retain the swimsuit system in a generally fixed position on the wearer's body, thus helping to maintain modesty and providing an aerodynamic profile. The upper-body garment of the modest swimsuit system also includes an integrated bra. The bra not only provides support but contributes to the modesty features of the swimsuit system.

Additionally, the head cover of the swimsuit system is configured to closely conform to a head of a wearer such that it provides modesty while still creating an aerodynamic profile. The head cover, in example aspects, includes a hair management pocket that helps to retain the wearer's hair thus helping to reduce wearer distractions. In example aspects, the head cover may be removably affixed or permanently affixed to the neck opening of the upper-body garment. This helps to retain the head cover in a fixed position while being worn and reduces potential drag points when swimming.

The term "swimsuit system" as used throughout this disclosure may encompass, for example an upper-body garment (e.g., tunic, jacket, coat, pullover, shirt, vest, and the like), a head cover (e.g., a hijab, a hat, a beanie, a swimcap, and the like), and/or a lower-body garment (e.g., short, pant, legging, capri, and the like). Positional terms used when describing the swimsuit system such as front, back, sides, inner-facing surface, outer-facing surface, upper or superior, lower or inferior, and the like are with respect to the swimsuit system being worn as intended by a wearer standing upright. As such, the front of an upper-body garment is configured to cover a front upper torso area and/or front arm areas of a wearer, and the front of a lower-body garment is configured to cover a front lower torso area and front leg areas of a wearer. The back of the upper-body garment is configured to cover a back upper torso area and/or back arm areas of a wearer, and the back of the lower-body garment is configured to cover a back lower torso area and back leg areas of a wearer. The sides of the upper-body garment are configured to cover side torso areas of a wearer, and the sides of the lower-body garment are configured to cover the lateral sides of a wearer's legs. The inner-facing surface of the respective garments of the swimsuit system is configured to be positioned facing toward a wearer's body surface, and the outer-facing surface of the respective garments is configured to face away from the inner-facing surface of the respective garments and toward an external environment. The term "innermost-facing layer" means the layer of the respective garments that is positioned closest to a wearer's body surface compared to other layers of the respective garments when the respective garments are in an as-worn configuration. The term "outermost-facing layer" means the layer of the respective garments that is positioned to be in direct contact with the external environment and/or is furthest away from the wearer's body surface compared to other layers of the respective garments. The term "interior" when referring to a layer or structure means located closer to a body surface of a wearer compared to another layer or structure. The term upper or superior means located closer to a neck opening of an upper-body garment or a waist opening of a lower-body garment. The term lower or inferior means located closer to a waist opening of an upper-body garment or leg openings of a lower-body garment. With respect to the head cover, the term upper or superior means located closer to the apex of a wearer's head, and the term lower or inferior means located closer to a neck area of the wearer.

The term "long sleeve" when referring to an upper-body garment means a sleeve that extends from generally a shoulder area of a wearer to a wrist area of the wearer. The term "leg portion" as used herein generally refers to a leg portion of a lower-body garment that extends from generally a hip area of a wearer to an ankle area of the wearer. The term "vent opening" as used herein generally refers to an opening formed in a garment that provides a fluid (e.g., air, water) communication path from an interior of the garment to an exterior of the garment. It is contemplated herein that the vent opening may be formed in a variety of ways and may include materials, such as a mesh material, that span the opening while still allowing the ingress and egress of fluids through the vent opening while preventing larger particulate items from entering the swimsuit. For example, the vent opening may be formed by discontinuously affixing a first panel edge to a second panel edge and inserting a mesh material in the opening thus formed. The term "discontinuously affixing" as used herein may mean fixing a first panel to a second panel at a first location that is spaced apart from a second location where an opening is formed that extends between the first location and the second location. The vent opening may also be formed by incorporating a mesh panel at a terminal edge of a first panel, and affixing the mesh panel to a second panel. Additional ways of forming vent openings as known in the art are within the scope herein.

The term "perimeter edge" or "edge" as used herein means a terminal edge of, for example, a panel of material. The perimeter edge may comprise a free edge (e.g., not affixed to another structure) or a fixed edge (e.g., affixed to another material or structure). The term "extendable" as used herein means configured to change from a first, retracted position to a second, extended position. The term "about" as used herein means within ±10% of an indicated value. Unless otherwise noted, all measurements provided herein are measured when the swimsuit system is at standard ambient temperature and pressure (25 degrees Celsius or 298.15 K and 1 bar) and is in a resting (e.g., un-stretched) state.

Figure 1B:
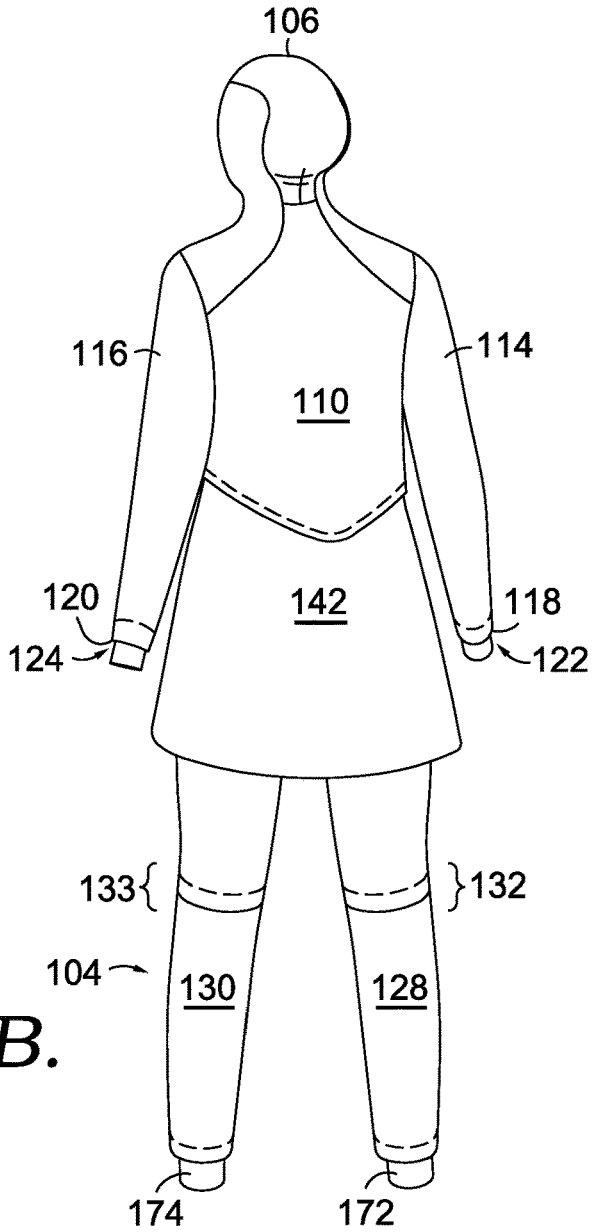
FIG. 1B illustrates a back view of the example swimsuit system of FIG. 1A in accordance with aspects herein.

FIGS. 1A and 1B respectively depict a front view and a back perspective view of an example swimsuit system 100 including an upper-body garment 102, a lower-body garment 104, and a head cover 106. The upper-body garment 102 is shown in the form of a tunic comprising a torso portion 110, a first long sleeve 114, and a second long sleeve 116. The torso portion 110 includes a front torso portion 140 and a back torso portion 142. While the upper-body garment 102 is shown in the form of a tunic, it is contemplated herein that the upper-body garment 102 may also be in the form of a jacket, shirt, a pullover, a vest, and the like.

In example aspects, one or more textile materials forming the upper-body garment 102 may include a lightweight material having a tightly woven construction although other constructions, such as a knit construction, are contemplated herein. Use of a tightly woven construction helps to prevent water from entering the swimsuit system 100 and prevents the swimsuit system 100 from becoming excessively heavy when exposed to water due to water retention by the material. The lightweight material may have a weight from about 140 grams per square meter (gsm) to about 165 gsm, from about 145 gsm to about 160 gsm, or about 155 gsm. Use of a lightweight material reduces garment weight which contributes to performance features of the swimsuit system 100. The lightweight material may include a number of different finishes or characteristics making the material suitable for prolonged exposure to water. Finishes may include an ultraviolet light protection finish, a chlorine resistant finish, a water repellant finish, an anti-pilling finish, and the like. It is contemplated herein that the material may include elastic yarns (e.g., spandex yarns) to provide two-way or four-way stretch helping the upper-body garment 102 to conform to the wearer's body surface and not bag or create drag points. One example textile material is Revolutional® manufactured by Carvico S.p.A. having a location at 96 24030, Carvico (BG) Italia. In example aspects, a mesh lining layer may be positioned interior to the material forming the upper-body garment 102 at one or more areas of the upper body garment 102.

In example aspects, the first long sleeve 114 includes an extendable elastic cuff 122 at a first wrist opening 118

(shown in FIG. 1B). The second long sleeve includes an extendable elastic cuff 124 at a second wrist opening 120 (also shown in FIG. 1B). In FIG. 1A, the extendable elastic cuffs 122 and 124 are in an extended position covering a portion of a hand of a wearer, while FIG. 1B illustrates the extendable elastic cuffs 122 and 124 in a retracted position. In example aspects, each of the extendable elastic cuffs 122 and 124 may be formed of a jersey knit that may include elastic yarns (e.g., spandex yarns) such that the extendable elastic cuffs 122 and 124 may expand or retract to fit different size wrists and hands. Additionally, each of the extendable elastic cuffs 122 and 124 located at the first wrist opening 118 and the second wrist opening 120 may include a thumb-receiving hole for insertion of a thumb when in the extended position to provide additional security and prevent movement or "riding up" of the first long sleeve 114 and the second long sleeve 116 while an individual is in motion in the water. The upper-body garment 102 may also include vent openings as further explained below.

The swimsuit system 100 also includes the head cover 106 that is coupled to a neck opening 112 of the upper-body garment 102. The head cover 106 may be formed of the same material as used to form the upper-body garment 102. In aspects, the head cover 106 is fixedly coupled to the upper-body garment 102 such that it is remains coupled to the upper-body garment 102 and cannot be removed. In this case, the head cover 106 may be sewn or bonded to the neck opening 112 of the upper-body garment 102 such that the head cover 106 is fully integrated with the upper-body garment 102. It is contemplated that in other aspects, the head cover 106 may be removably coupled to the upper-body garment 102 at the neck opening 112, such that the head cover 106 may be removed by the wearer. In such instances, the head cover 106 may be removably coupled to the neck opening 112 via a fastening mechanism such as a hook closure, snaps, hook-and-loop fasteners, slider mechanisms, buttons, and the like. Additional features of the head cover 106 are provided with respect to FIGS. 4, 5A and 5B.

The swimsuit system 100 further includes the lower-body garment 104. The lower-body garment 104 may be formed of the same material as used to form the upper-body garment 102. The lower-body garment 104 includes a torso portion (shown in FIG. 3A-3B), a first leg portion 128, and a second leg portion 130. While the lower-body garment 104 is shown in the form of a pant, it is contemplated herein that the lower-body garment 104 may also be in the form of shorts, capris, and the like. The first leg portion 128 has a first ankle opening 132, and the second leg portion 130 has a second ankle opening 134. Each of the first ankle opening 132 and the second ankle opening 134 include extendable elastic cuffs 172 and 174, respectively. The extendable elastic cuffs 172 and 174 are in an extended position in FIGS. 1A and 1*n* a retracted position in FIG. 1B. When the extendable elastic cuffs 172 and 174 are in the extended position, they cover a portion of the wearer's foot such as part of the dorsum of the wearer's foot, part of the heel area of the wearer's foot, and part of the sole of the wearer's foot. Further, the lower-body garment 104 includes at least one vent opening at a posterior aspect of a first knee portion 135 of the first leg portion 128 and a posterior aspect of a second knee portion 133 of the second leg portion 130 as shown in FIG. 1B and as described further with respect to FIGS. 3A and 3B.

Figure 2A:
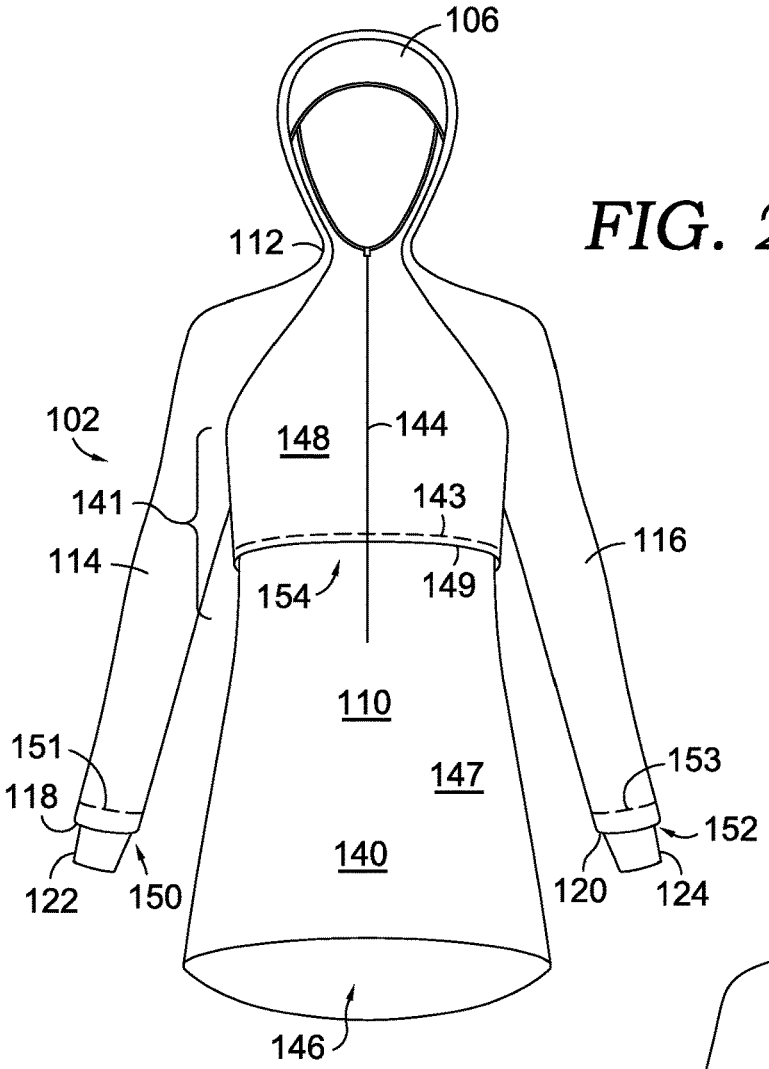
FIG. 2A illustrates a front view of an example upper-body garment of the swimsuit system of FIG. 1A in accordance with aspects herein.
Figure 2B:
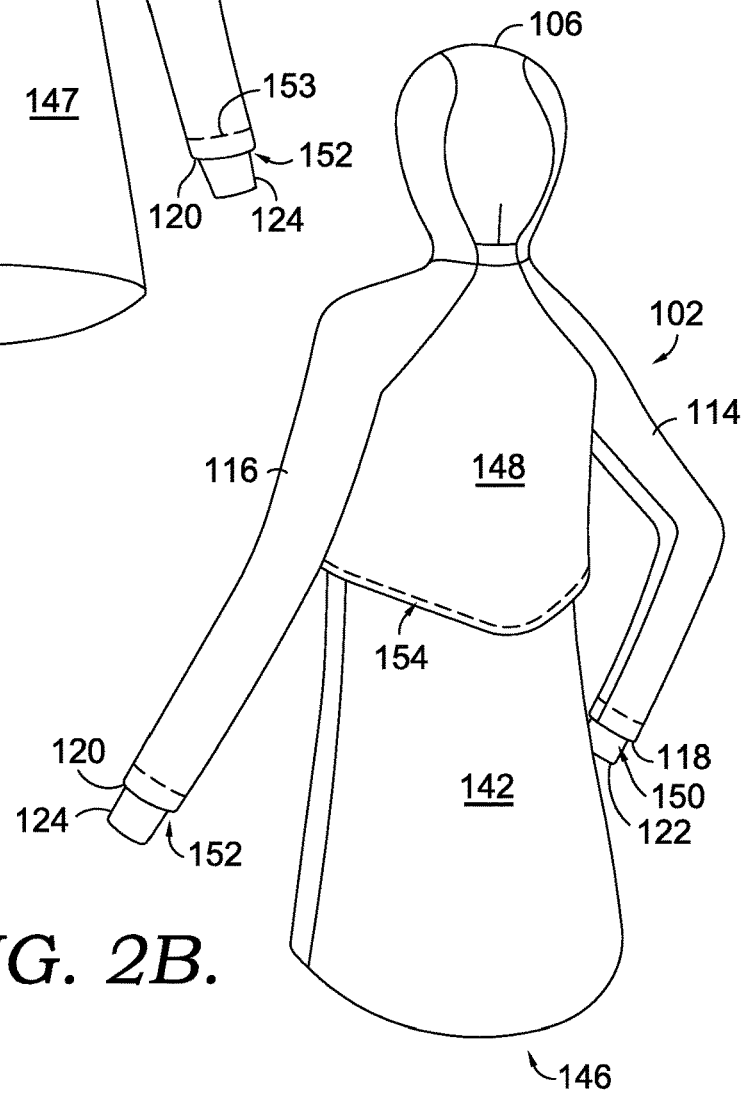
FIG. 2B illustrates a back perspective view of the upper-body garment of FIG. 2A in accordance with aspects herein.
Figure 2C:
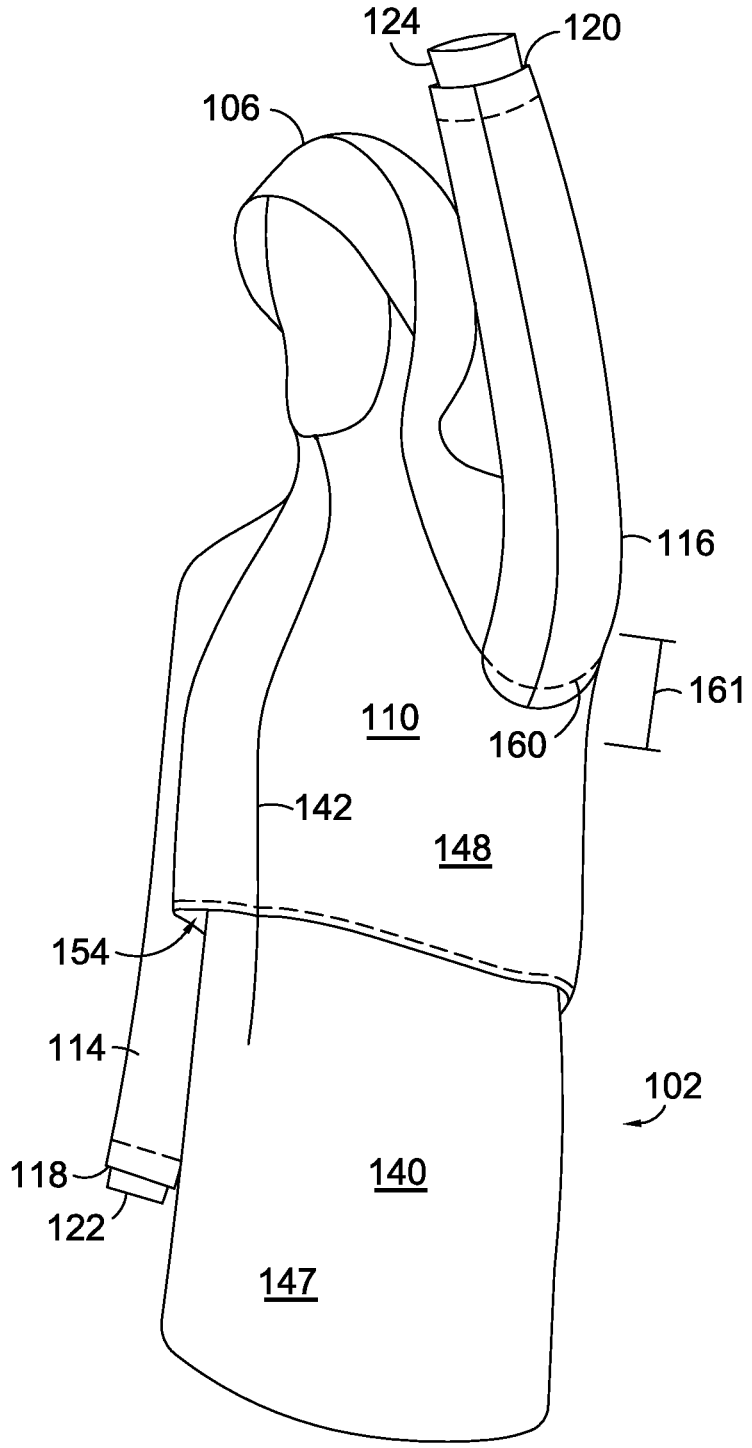
FIG. 2C illustrates a side view of the upper-body garment of FIG. 2A with a sleeve raised in accordance with aspects herein.

FIGS. 2A-2C respectively illustrate a front view, a back perspective view, and a side view of the upper-body garment 102 and the head cover 106 of the swimsuit system 100. The upper-body garment 102 includes the torso portion 110 that defines the neck opening 112 and a waist opening 146. The torso portion 110 may include a slider mechanism 144 that extends at least partially along the front of the torso portion 110 from a face opening of the head cover 106 to a point approximately midway between the neck opening 112 and the waist opening 146. The slider mechanism 144 may be used to facilitate donning and doffing the upper-body garment 102.

As shown, a first end 151 of the extendable elastic cuff 122 is coupled to an inner-facing surface of the first long sleeve 114 proximate (e.g., within about 2 cm to about 10 cm) to the first wrist opening 118 as indicated by the dashed line. In example aspects, the first end 151 of the extendable elastic cuff 122 may include a mesh insert such that the mesh insert is coupled to the inner-facing surface of the first long sleeve 114. This construction forms a vent opening 150 that allows for outflow of water through the mesh insert. As can be seen in FIGS. 2A and 2B, the first end 151 of the extendable elastic cuff 122 is continuously affixed to the inner-facing surface of the first long sleeve 114 proximate to the first wrist opening 118 such that the vent opening 150 is circumferential in shape.

Similar to the first long sleeve 114, the second long sleeve 116 includes the extendable elastic cuff 124. A first end 153 of the extendable elastic cuff 124 is coupled to an inner-facing surface of the second long sleeve 116 proximate (e.g., within about 2 cm to about 10 cm) to the second wrist opening 120 as indicated by the dashed line. In example aspects, the first end 153 of the extendable elastic cuff 124 includes a mesh insert such that the mesh insert is coupled to the inner-facing surface of the second long sleeve 116. This construction forms a vent opening 152 that allows for outflow of water through the mesh insert. As can be seen in FIGS. 2A and 2B, the first end 153 of the extendable elastic cuff 124 is continuously affixed to the inner-facing surface of the second long sleeve 116 proximate to the second wrist opening 120 such that the vent opening 152 is circumferential in shape.

While the vent openings 150 and 152 are shown extending circumferentially around the inner-facing surface of the first long sleeve 114 and the second long sleeve 116 respectively, it is contemplated that in other aspects, the vent openings 150 and 152 may not continuously extend around the perimeter of the first and second long sleeves 114 and 116 and may only be present on the front or the back of each of the first long sleeve 114 and the second long sleeve 116. Any and all aspects, and any variation thereof, are contemplated as being within aspects herein.

The extendable elastic cuffs 122 and 124 are shown in the retracted position in FIGS. 2A, 2B and 2C. When retracted, the extendable elastic cuffs 122 and 124 are not engaged or coupled with the hand of the wearer. By contrast, when the extendable elastic cuffs 122 and 124 are in the extended position (shown in FIG. 1A), the extendable elastic cuffs 122 and 124 extend over at least a portion of the hand of the wearer. As described below, in example aspects, the extendable elastic cuffs 122 and 124 include a thumb-receiving hole for insertion of a wearer's thumb when the extendable elastic cuffs 122 and 124 are in the extended position to reduce shifting of the first long sleeve 114 and the second long sleeve 116 when the wearer is in motion in the water.

In aspects, in addition to the vent openings 150 and 152 proximal to the first and second wrist openings 118 and 120, the upper-body garment 102 may include additional vent openings such as vent opening 154 which extends circumferentially around the torso portion 110 approximately midway between the neck opening 112 and the waist opening 146. Like the vent openings 150 and 152, the vent opening 154 provides additional points of water outflow in the swimsuit system 100. The vent opening 154 is formed by overlapping panel edges of an upper layer 148 and a lower layer 147. For instance, a first edge 143 of the lower layer 147 may be coupled to an inner-facing surface of the upper layer 148 proximate (within about 2 cm to about 10 cm) to a lower edge 149 of the upper layer 148 in a chest region 141 of the upper-body garment 102. In example aspects, the first edge 143 of the lower layer 147 may include a mesh material to facilitate water flow. In example aspects, the lower edge 149 of the upper layer 148 remains uncoupled from the lower layer 147, thereby forming the vent opening 154, best seen in FIG. 2C.

In additional aspects, vent openings may also be located adjacent to where the first long sleeve 114 extends from a sleeve opening of the torso portion 110 and adjacent to where the second long sleeve 116 extends from a sleeve opening of the torso portion 110 at an armpit region 161 of each of the first long sleeve 114 and the second long sleeve 116 to provide an additional egress point for water. This is shown in FIG. 2C, where a vent opening 160 is located at the armpit region 161. In example aspects, the vent opening 160 may be formed by discontinuously affixing a proximal end of the second long sleeve 116 to the torso portion 110 at the armpit region 161 and positioning a mesh insert within the opening thus formed. A similar vent opening may be formed in the same manner at the junction of the first long sleeve 114 with the torso portion 110. The locations of the vent openings 150, 152, 154 and 160 may be selected based on optimal egress routes for water to leave the upper-body garment 102. For instance, the locations of the vent openings 150, 152, 154, and 160 represent locations where water is likely to exit the upper-body garment 102 due to gravity when a wearer is standing upright. Additional vent openings not shown may be incorporated into the upper-body garment 102.

Figure 2D:
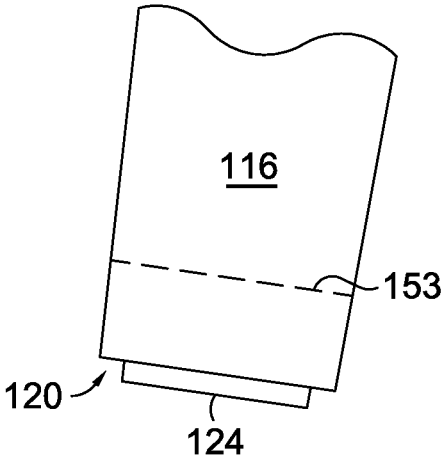
FIG. 2D illustrates a side view of an example extendable elastic cuff in a retracted position and located at a wrist opening of the upper-body garment of FIG. 2A in accordance with aspects herein.
Figure 2E:
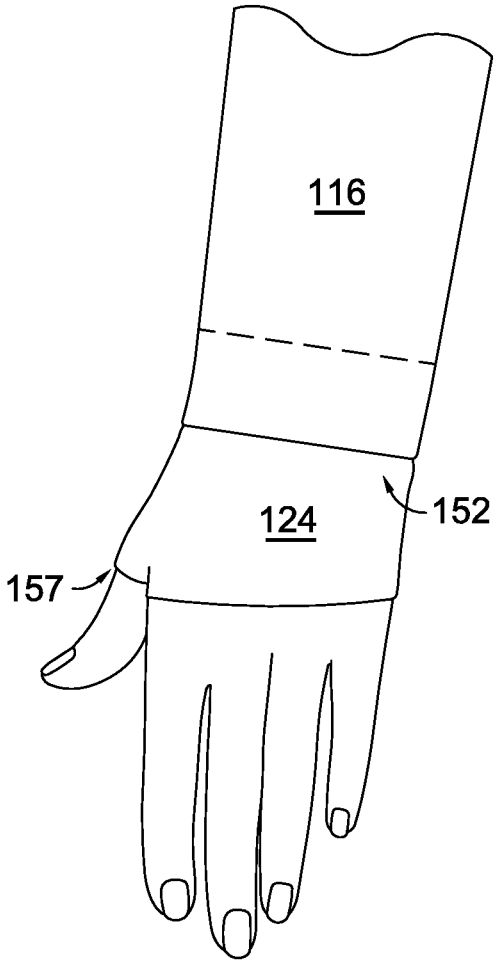
FIG. 2E illustrates the side view of the example extendable elastic cuff of FIG. 2D in an extended position in accordance with aspects herein.

FIGS. 2D and 2E illustrate the extendable elastic cuff 124 of the upper-body garment 102. As shown in FIG. 2D, the second long sleeve 116 has the second wrist opening 120 and the extendable elastic cuff 124 is depicted in a retracted position. As such, the extendable elastic cuff 124 is generally positioned interior to the second long sleeve 116. When the extendable elastic cuff 124 is extended as shown in FIG. 2E, the extendable elastic cuff 124 extends at least partially over the hand of the wearer and includes a thumb-receiving hole 157 for insertion of the wearer's thumb to better secure the second long sleeve 116 in position. The extendable elastic cuff 122 of the first long sleeve 114 has a similar configuration.

Figure 3A:
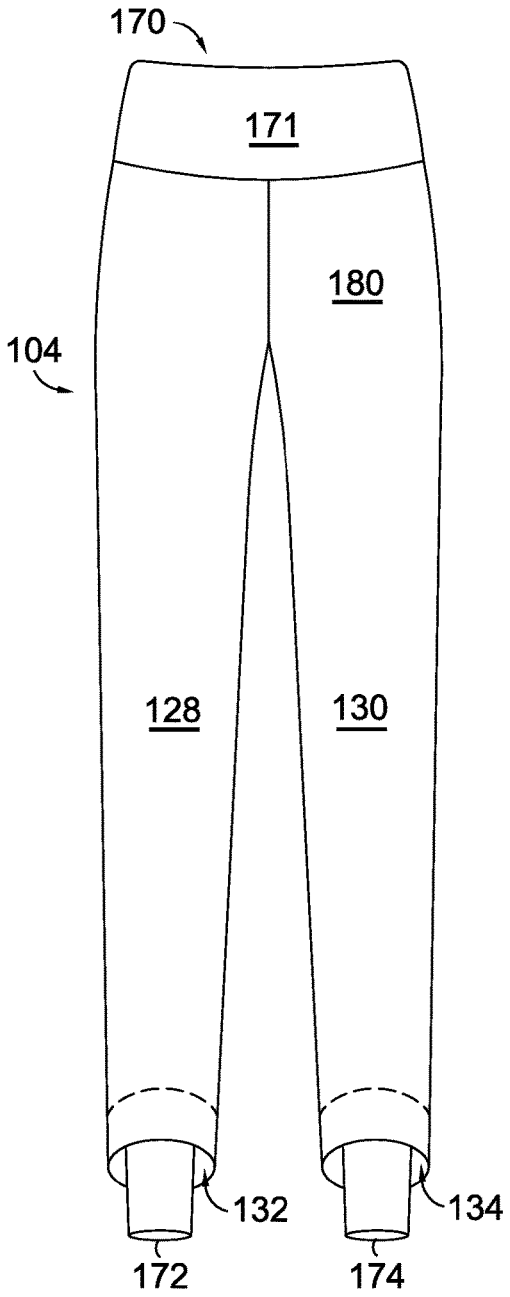
FIG. 3A illustrates a front view of an example lower-body garment of the swimsuit system of FIG. 1A in accordance with aspects herein.
Figure 3B:
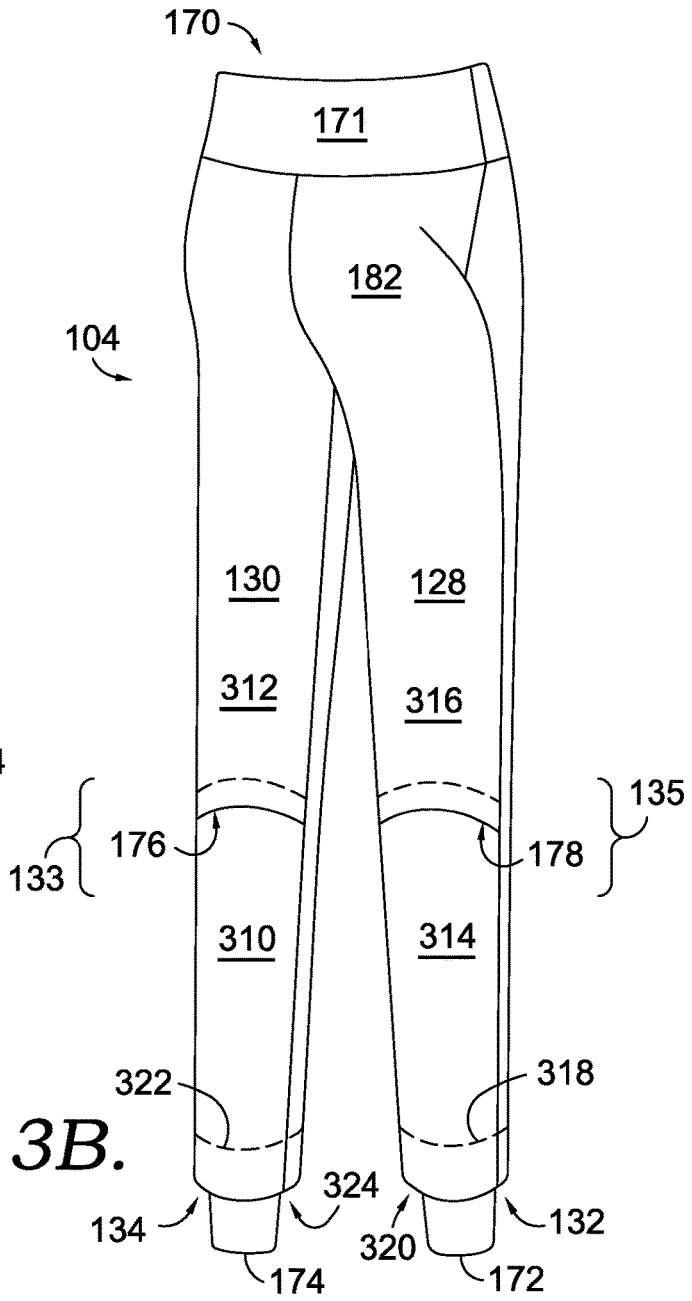
FIG. 3B illustrates a back perspective view of the example lower-body garment of FIG. 3A in accordance with aspects herein.

FIGS. 3A and 3B illustrate a front view and a back perspective view respectively of the lower-body garment 104 of the swimsuit system 100. The lower-body garment 104 includes a torso portion 170, a front portion 180, a back portion 182, a waistband 171, the first leg portion 128 and the second leg portion 130. The first leg portion 128 extends from the torso portion 170 to the first ankle opening 132, and the second leg portion 130 extends from the torso portion 170 to the second ankle opening 134. As mentioned above, each of the first leg portion 128 and the second leg portion 130 include the extendable elastic cuffs 172 and 174. Further, the lower-body garment 104 includes vent opening 178 at the first knee portion 135 and vent opening 176 at the second knee portion 133 located on the back portion 182 of the lower-body garment 104. While shown in FIG. 3B as located solely on the back portion 182 of the lower-body garment 104, it is contemplated that in aspects, the vent openings 176 and 178 may extend circumferentially around the first knee portion 135 and the second knee portion 133. Additionally, in example aspects, the vent openings 176 and 178 may be located solely on the front portion 180 of the lower-body garment 104. Any and all aspect, and any variation thereof, are contemplated as being within the scope herein.

In example aspects, the vent opening 176 may be formed by discontinuously affixing a back lower panel 310 of the second leg portion 130 to a back upper panel 312 of the second leg portion 130 and positioning a mesh insert within the opening thus formed. Similarly, the vent opening 178 may be formed by discontinuously affixing a back lower panel 314 of the first leg portion 128 to a back upper panel 316 of the first leg portion 128 and positioning a mesh insert within the opening thus formed. It is also contemplated herein that the vent openings 176 and 178 may be formed by affixing an upper edge of the back lower panels 310 and 314 to an inner-facing surface of the back upper panels 312 and 316 where the upper edge of the back lower panels 310 and 314 may be formed from a mesh material. Additional ways of forming the vent openings 176 and 178 are contemplated herein. In addition to the vent openings 176 and 178, the lower-body garment 104 may also include vent openings at the first ankle opening 132 and the second ankle opening 134 similar to the vent openings 150 and 152 of the upper-body garment 102. For example, a first end 318 of the extendable elastic cuff 172 is coupled to an inner-facing surface of the first leg portion 128 proximate (e.g., within about 2 cm to about 10 cm) to the first ankle opening 132 as indicated by the dashed line. In example aspects, the first end 318 of the extendable elastic cuff 172 includes a mesh insert such that the mesh insert is coupled to the inner-facing surface of the first leg portion 128. This construction forms a vent opening 320 that allows for outflow of water through the mesh insert. As can be seen in FIGS. 3A and 3B, the first end 318 of the extendable elastic cuff 172 is continuously affixed to the inner-facing surface of the first leg portion 128 proximate to the first ankle opening 132 such that the vent opening 320 is circumferential in shape.

Similarly, a first end 322 of the extendable elastic cuff 174 is coupled to an inner-facing surface of the second leg portion 130 proximate (e.g., within about 2 cm to about 10 cm) to the second ankle opening 134 as indicated by the dashed line. In example aspects, the first end 322 of the extendable elastic cuff 174 includes a mesh insert such that the mesh insert is coupled to the inner-facing surface of the second leg portion 130. This construction forms a vent opening 324 that allows for outflow of water through the mesh insert. As can be seen in FIGS. 3A and 3B, the first end 322 of the extendable elastic cuff 174 is continuously affixed to the inner-facing surface of the second leg portion 130 proximate to the second ankle opening 134 such that the vent opening 324 is circumferential in shape.

While the vent openings 320 and 324 are shown extending circumferentially around the inner-facing surface of the first leg portion 128 and the second leg portion 130, it is contemplated that in other aspects, the vent openings 320 and 324 may not continuously extend around the perimeter of the first and second leg portions 128 and 130 and may only be present on the front or the back of each of the first leg portion 128 and the second leg portion 130. Any and all aspects, and any variation thereof, are contemplated as being within aspects herein.

In example aspects, the waistband 171 may optionally include a mesh lining (not shown) to provide additional water outflow and minimize trapped air. Further, in aspects, the waistband 171 may optionally include a draw cord to circumferentially tension the waistband 171 to provide a more secure fit. In yet other aspects, the waistband 171 may optionally include a pocket with a closure mechanism located on a back portion of the waistband 171 and providing for secure storage of small essentials.

Figure 3C:
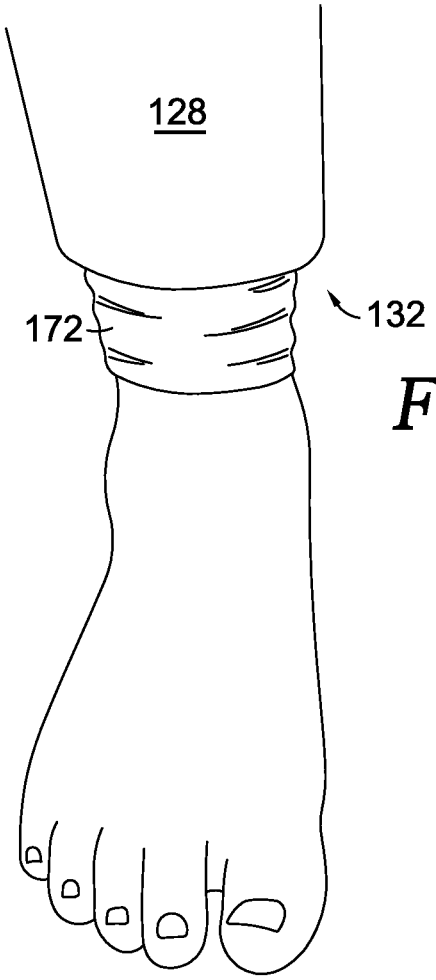
FIG. 3C illustrates a front view of an example extendable elastic cuff of the lower-body garment of FIG. 3A in a retracted position in accordance with aspects herein.
Figure 3D:
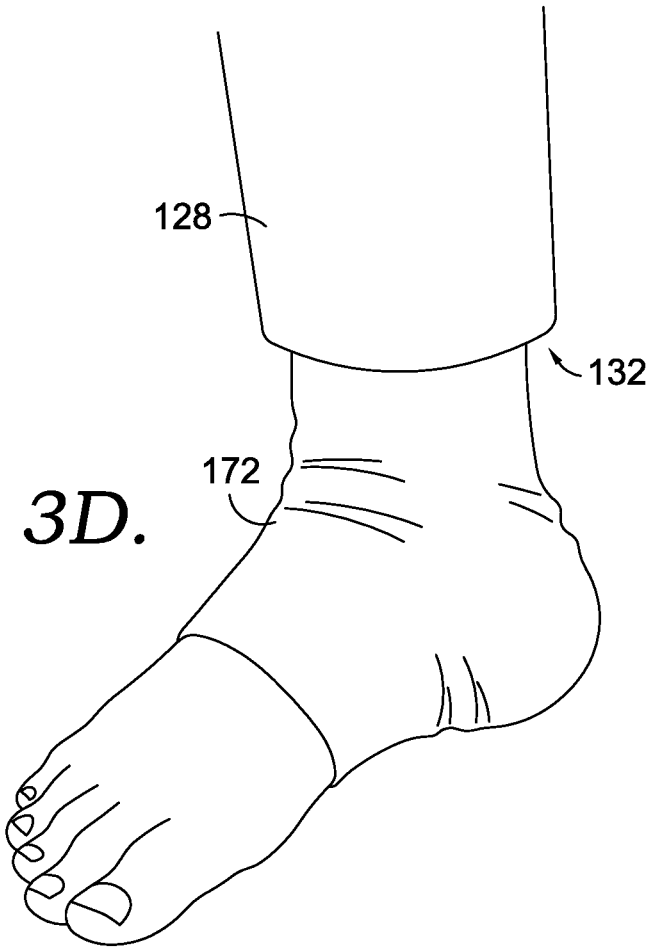
FIG. 3D illustrates a perspective view of the extendable elastic cuff of FIG. 3C in an extended position in accordance with aspects herein.

FIGS. 3C and 3D illustrate the extendable elastic cuff 172 of the first leg portion 128. In FIG. 3C, the extendable elastic cuff 172 is shown in a retracted position such that it is generally located interior to the first leg portion 128. FIG. 3D illustrates the extendable elastic cuff 172 in an extended position such that it at least partially covers the dorsum, the heel, and the sole of a wearer's foot. The extendable elastic cuff 174 of the second leg portion 130 would have a similar configuration.

Figure 4:
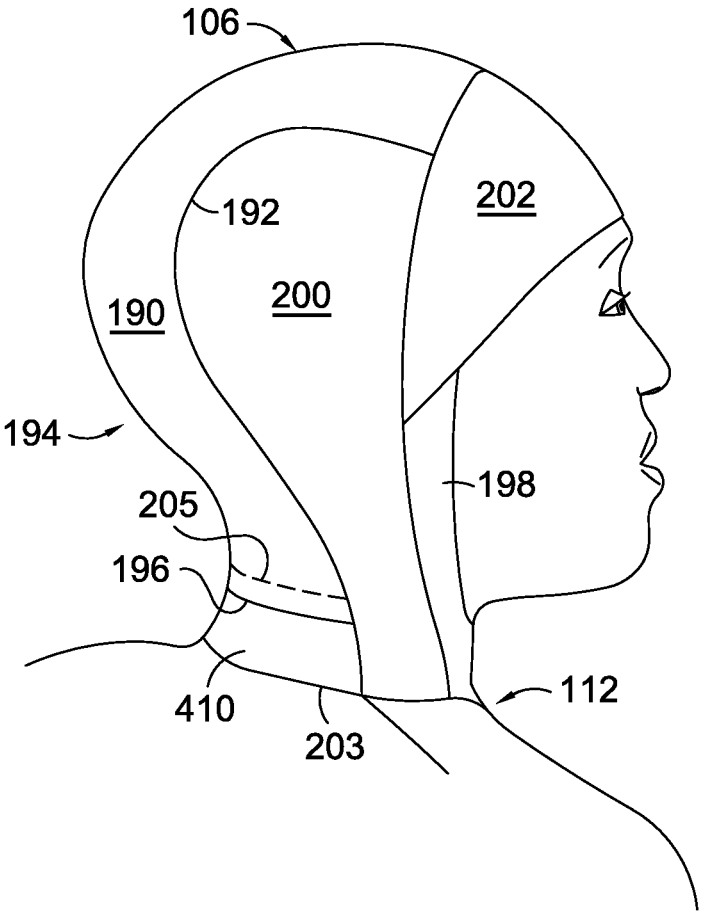
FIG. 4 illustrates a side perspective view of an example head cover of the swimsuit system of FIG. 1A in accordance with aspects herein.

FIG. 4 depicts a side perspective view of the head cover 106 of the swimsuit system 100. The head cover 106 is coupled to the neck opening 112 of the upper-body garment 102 at 203. In example aspects, the head cover 106 may include a multi-panel construction as shown, although it is also contemplated herein that the head cover 106 may be formed of a single panel. In example aspects, the head cover 106 includes a rear panel 190, a first side panel 200, a second side panel (not shown), and a front panel 202 that collectively define a face opening of the head cover 106. The seaming of the different panels may help to shape the head cover 106 to more securely fit a wearer's head. For instance, seam 192 may be curved as shown such that the panels 190 and 200 lay flat against the wearer's head. A similar seam may be located between the second side panel and the rear panel 190. The head cover 106 may include an elastic band 198 that circumscribes, or at least partially circumscribes, the face opening to provide a snug and comfortable fit around various face shapes. The elastic band 198 may not only help the face opening to lie flush with the wearer's face (i.e., no gaps) but also may help reduce shifting of the face opening during movement. This, in turn, helps to keep the wearer's line-of-sight clear and further helps to maintain the modesty coverage of the head cover 106.

Additionally, the head cover 106 includes a vent opening 196 on a back side 194 of the head cover 106 which allows for breathability and additional water flow. To form the vent opening 196, an upper edge 205 of a panel 410 (indicated by a dashed line) may be discontinuously affixed to a lower edge of the rear panel 190, and a mesh insert may be positioned within the opening thus formed to create the vent opening 196.

Figure 5A:
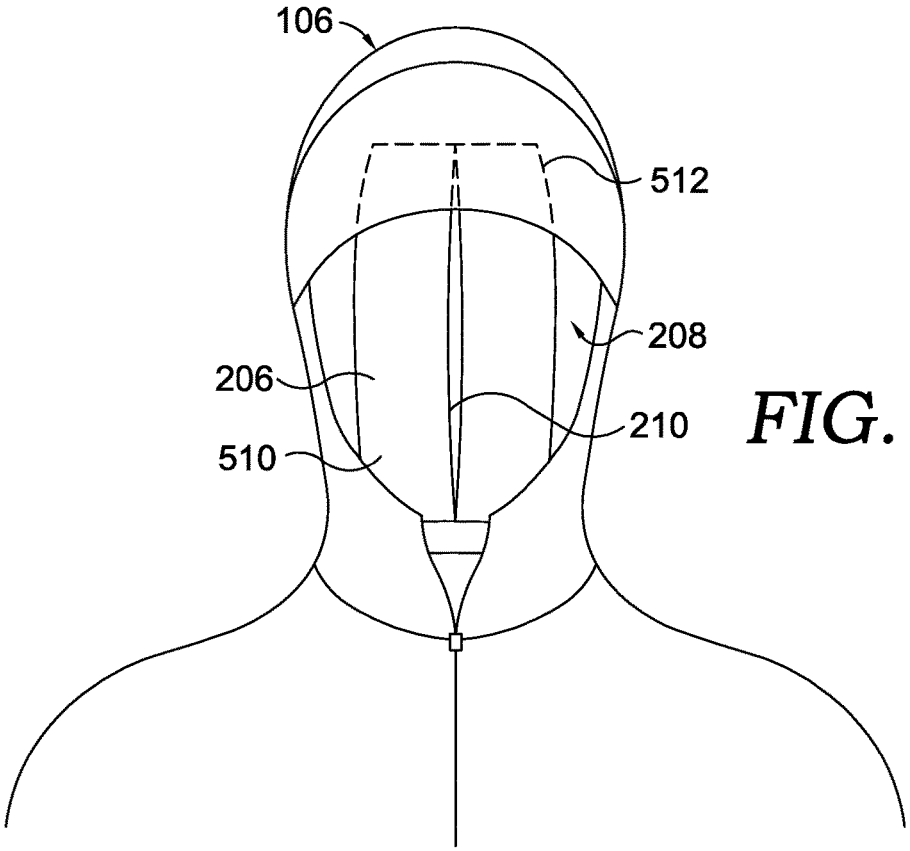
FIG. 5A illustrates a front view of the example head cover of FIG. 4 comprising a hair management pocket in accordance with aspects herein.
Figure 5B:
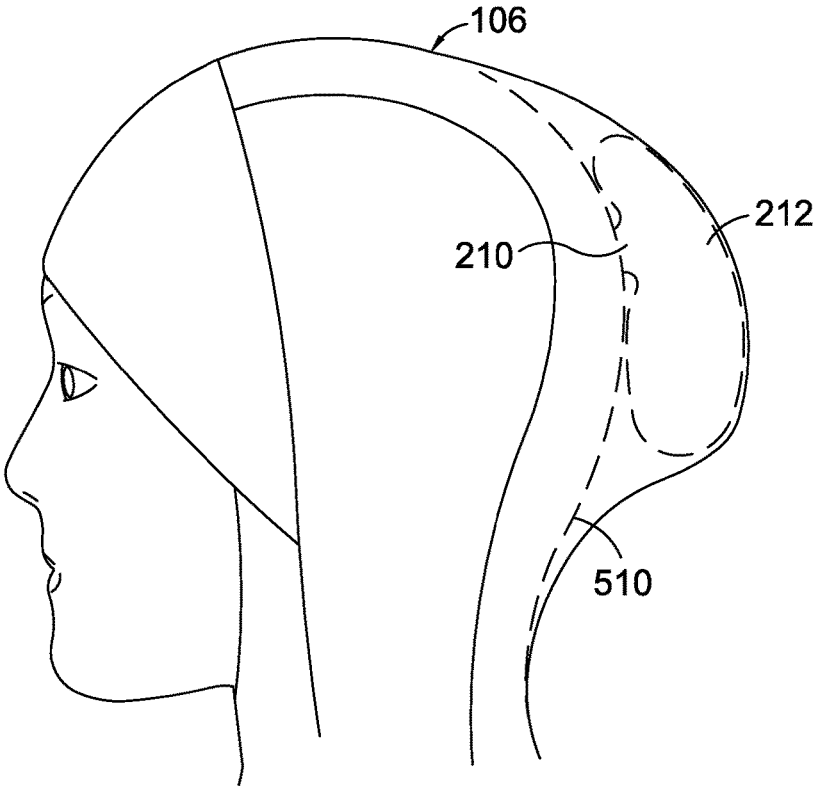
FIG. 5B illustrates a side perspective view of the head cover of FIG. 5A depicting a wearer's hair positioned within the hair management pocket in accordance with aspects herein.

FIGS. 5A and 5B illustrate a front view and a side view of the head cover 106 and further illustrate a hair management pocket 206 that is positioned at a back aspect of the head cover 106. The hair management pocket 206 is formed by affixing a panel of material 510 to an inner-facing surface 208 of the head cover 106 along a perimeter edge 512 of the panel of material 510 to form a pocket space 212 between the panel of material 510 and the inner-facing surface 208 of the head cover 106 (shown in FIG. 5B). The panel of material 510 includes a vertically oriented opening 210 that is in communication with the pocket space 212 and is configured to receive the hair of a wearer. The panel of material 510 may be formed from a lightweight elastic mesh fabric that provides flexibility to hold different amounts of hair and allows for breathability and water flow as well as control of the hair to minimize distractions and interference.

As shown in FIG. 5B, a wearer's hair is inserted through the vertically oriented opening 210 into the pocket space 212. When a wearer dons the head cover 106, they can insert their hair, via the vertically oriented opening 210, into the pocket space 212 prior to or while pulling the head cover 106 over the top of their head. Based on the volume of hair, the panel of material 510 will flex to hold the hair in place while the wearer wears the head cover 106.

Figure 6B:
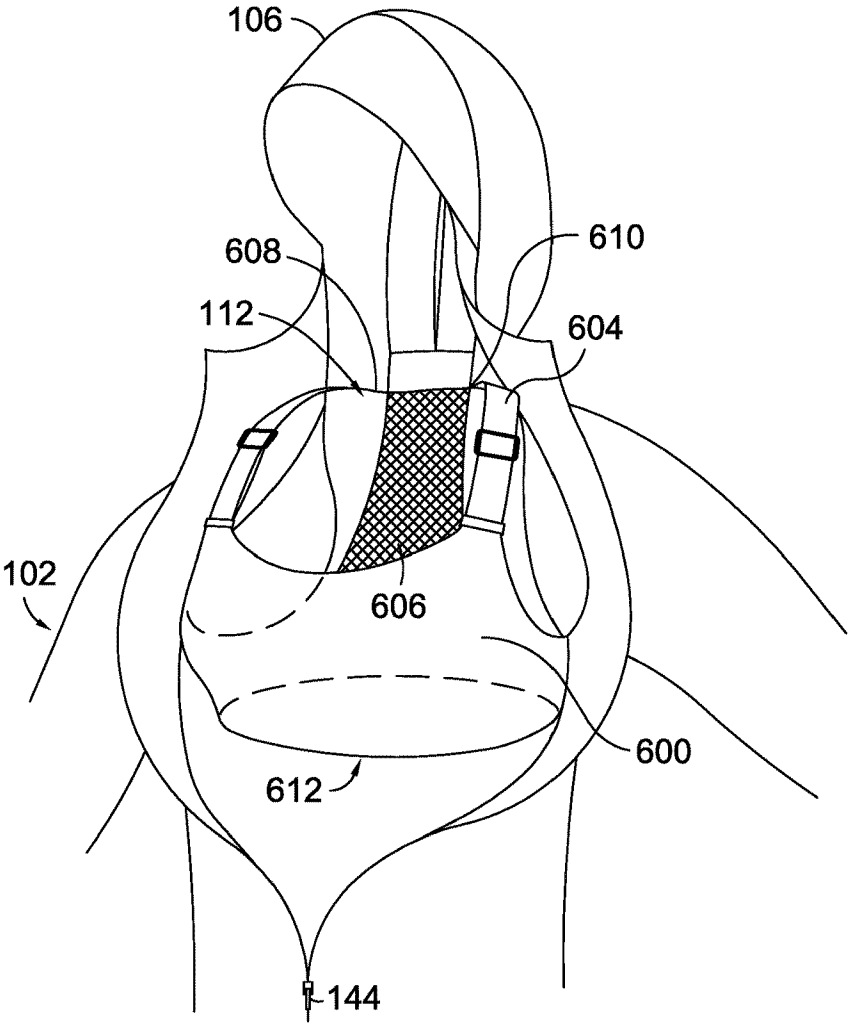
FIG. 6B illustrates a front perspective view of the integrated bra shown in FIG. 6A in accordance with aspects herein.
Figure 6A:
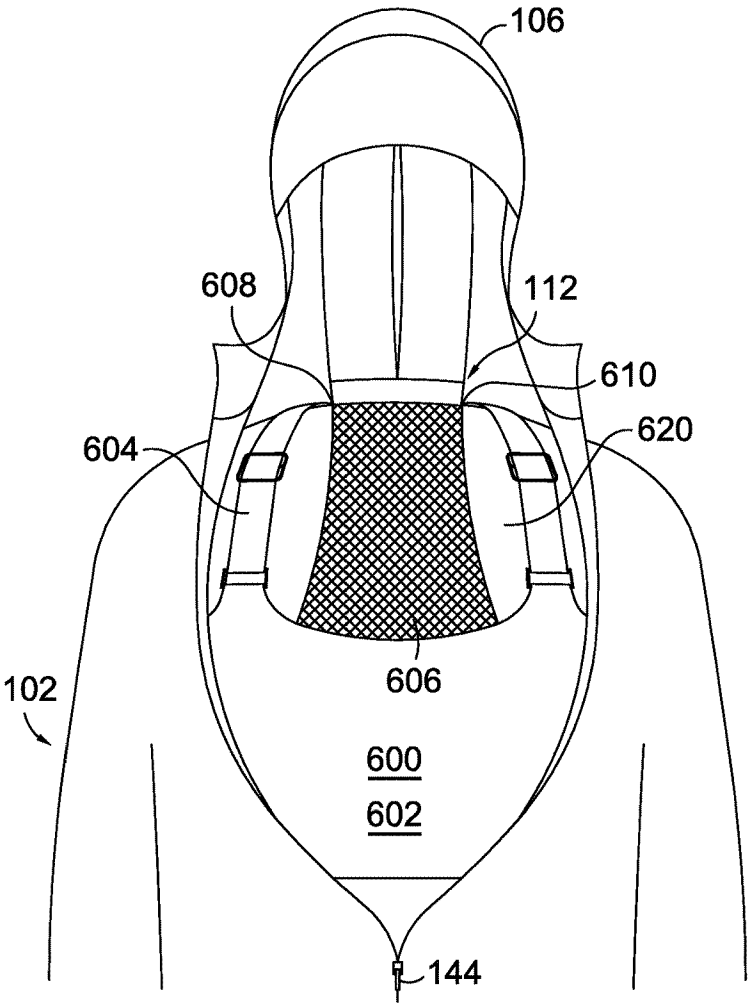
FIG. 6A illustrates a front view of an example upper-body garment of the swimsuit system of FIG. 1A comprising an integrated bra in accordance with aspects herein.

FIGS. 6A and 6B illustrate a front view and a perspective view respectively of an example bra 600 integrated into the upper-body garment 102. As shown, the slider mechanism 144 of the upper-body garment 102 has been opened to show an inner-facing surface 620 of the upper-body garment 102. The bra 600 includes a front side 602, a back side 606, and a pair of adjustable shoulder straps 604. The adjustable shoulder straps 604 extend from the front side 602 of the bra 600 and are affixed adjacent to the neck opening 112 of the upper-body garment 102 at 608 and 610. Additionally, while not shown, the bra 600 may include a mesh frame surrounding breast cup portions of the bra 600 to allow water flow out of the bra 600.

As shown in FIG. 6B, the back side 606 is attached at the neck opening 112 at locations 608 and 610. In example aspects, this may comprise the only points of attachment of the back side 606 to the upper-body garment 102. As such, the front side 602 and the back side 606 of the bra 600 may be free-floating with respect to the upper-body garment 102. This construction allows for additional freedom of movement and water flow. In example aspects, the back side 606 of the bra is formed of a mesh fabric to facilitate water flow while the front side 602 is formed of a jersey knit material for support and modesty. Additionally, the bra 600 may include an underband 612 for additional support to a wearer's breasts.

Figure 7A:
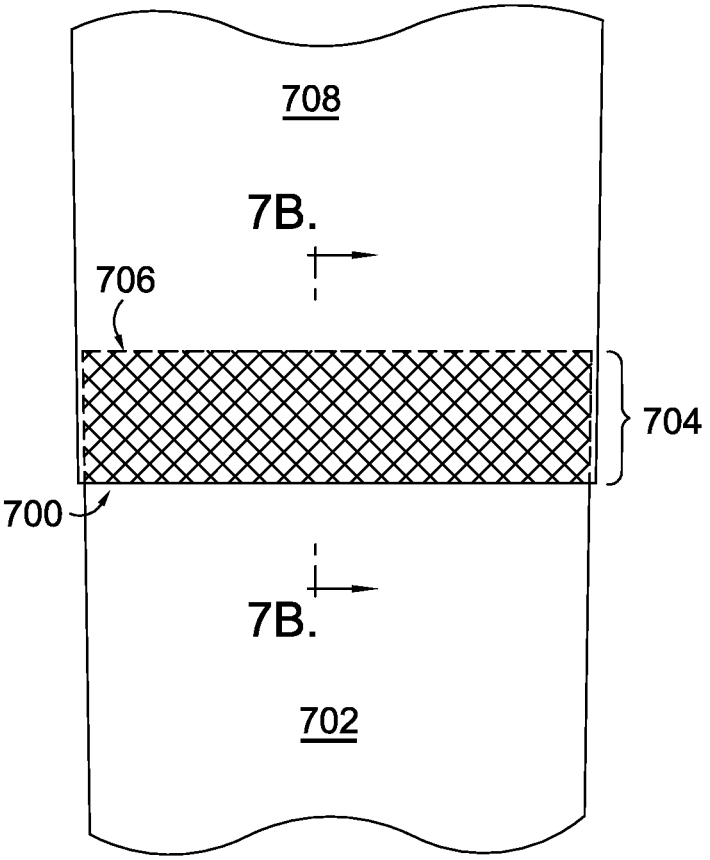
FIG. 7A illustrates a close up of an example vent opening in accordance with aspects herein.
Figure 7B:
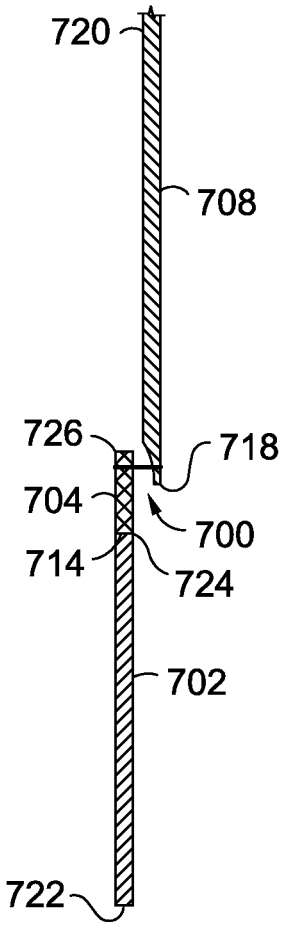
FIG. 7B illustrates a cross section taken at line 7B-7B in accordance with aspects herein.

FIG. 7A illustrates a close up of an example vent opening 700 that may comprise, for example, any of vent openings 150, 152, 154, 176, 178, 172, and 174. FIG. 7B illustrates a cross-section of the vent opening 700 taken at the indicated cut line. As shown, the vent opening 700 is formed by overlapping and affixing edges of panels of material where an edge of at least one of the panels includes a mesh insert. By way of example, the vent opening 700 may be formed from a first panel of material 702 that includes a mesh insert 704. The mesh insert 704 includes a second end 724 that is coupled to a terminal edge 714 of the first panel of material 702. A first end 726 of the mesh insert 704 is attached to an inner-facing surface 720 of a second panel of material 708 to form the vent opening 700. The use of a mesh material allows for increased water flow through the insert. Other ways of forming the vent opening 700 are contemplated herein. For example, the panel of material 702 may be discontinuously affixed to the panel of material 708 to form an opening, and a mesh insert, such as the mesh insert 704 may be positioned within the opening.

Figure 8:
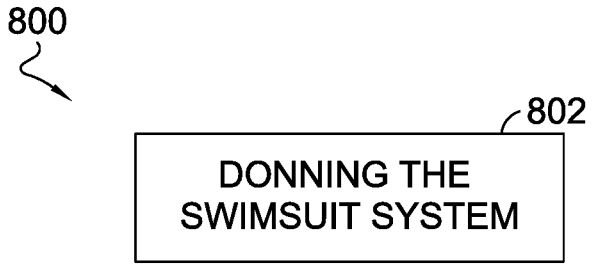
FIG. 8 illustrates a flow diagram of an example method of using the swimsuit system of FIG. 1A in accordance with aspects herein.

FIG. 8 illustrates a flow diagram of an example method 800 of donning a swimsuit system, such as the swimsuit system 100. At step 802, the swimsuit system 100 is donned. This may include for example, donning the upper-body garment 102 while the slider mechanism 144 is in an unzipped position, positioning the bra 600 over the wearer's breasts, and positioning the head cover 106 over the wearer's head. The wearer's hair may be positioned with the pocket space 212 of the hair management pocket 206. Donning the swimsuit system may additionally include donning the lower-body garment 104.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and sub combinations are of utility and may be employed without reference to other features and subcombinations and are contemplated within the scope of the claims. Not all steps listed in the various figures need be carried out in the specific order described.

What is claimed is:

1. A swimsuit system comprising:

an upper-body garment having a torso portion defining a neck opening, a first long sleeve extending from the torso portion and having a first wrist opening, and a second long sleeve extending from the torso portion and having a second wrist opening, wherein the first wrist opening and the second wrist opening each include an extendable elastic cuff, and wherein the upper-body garment includes at least one vent opening at the first long sleeve and at least one vent opening at the second long sleeve;

a head cover coupled to the neck opening of the upper-body garment comprising a vent opening located on a posterior portion of the head cover, the vent opening including a mesh panel that couples an upper edge of a neck panel to a lower edge of the head cover; and a lower-body garment having a torso portion, a first leg portion extending from the torso portion and having a first ankle opening, and a second leg portion extending from the torso portion and having a second ankle opening, wherein the first ankle opening and the second ankle opening each include an extendable elastic cuff, and wherein the lower-body garment includes at least one vent opening located at one or more of a first knee area of the first leg portion and a second knee area of the second leg portion, wherein the at least one vent opening of the lower-body garment extends circumferentially around a posterior region of the first knee area and around a posterior region of the second knee area.

2. The swimsuit system of claim 1, wherein the at least one vent opening at the first long sleeve is located adjacent to a junction between the first long sleeve and the torso portion, and the at least one vent opening at the second long sleeve is located adjacent to a junction between the second long sleeve and the torso portion.

3. The swimsuit system of claim 1, wherein the torso portion of the upper-body garment includes a mesh layer located interior to an outer layer.

4. The swimsuit system of claim 1, further comprising a bra having a front side, a back side, and a pair of shoulder straps that extend from the front side and that are affixed adjacent to the neck opening of the upper-body garment.

5. The swimsuit system of claim 1, wherein the head cover comprises a panel of material having a perimeter edge that is affixed to an inner surface of the head cover at a back side of the head cover, the panel of material having a vertically oriented opening configured to receive hair of a wearer.

6. The swimsuit system of claim 1, wherein the extendable elastic cuff of the first wrist opening and the second wrist opening includes a thumb-receiving hole.

7. The swimsuit system of claim 1, wherein the extendable elastic cuff of the first ankle opening and the second ankle opening is configured to extend at least partially over an instep area and a sole of a wearer when the lower-body garment is in an as-worn configuration.

8. The swimsuit system of claim 1, wherein the at least one vent opening on the upper-body garment and the at least one vent opening on the lower-body garment include a mesh insert that extends across the respective vent opening.

9. A method of using the swimsuit system of claim 1 comprising:

donning the swimsuit system.

10. A swimsuit system comprising:

an upper-body garment having a torso portion defining a neck opening, a first long sleeve extending from a first sleeve opening of the torso portion and having a first wrist opening, and a second long sleeve extending from a second sleeve opening of the torso portion and having a second wrist opening, wherein the first wrist opening and the second wrist opening each include an extendable elastic cuff, and wherein the upper-body garment includes at least one vent opening at one or more of the neck opening, the first long sleeve, and the second long sleeve;

a bra having a front side, a back side, and a pair of shoulder straps that extend from the front side and are affixed adjacent to the neck opening of the upper-body garment; and a head cover fixedly coupled to the neck opening of the upper-body garment, wherein the head cover further comprises a vent opening located on a posterior portion of the head cover, wherein the vent opening located on a posterior portion of the head cover includes a mesh panel that couples an upper edge of a neck panel to a lower edge of the head cover.

11. The swimsuit system of claim 10, further comprising a lower-body garment having a torso portion, a first leg portion extending from the torso portion and having a first ankle opening, and a second leg portion extending from the torso portion and having a second ankle opening, wherein the first ankle opening and the second ankle opening each include an extendable elastic cuff, and wherein the lower-body garment includes at least one vent opening located at one or more of a first knee area of the first leg portion and a second knee area of the second leg portion.

12. The swimsuit system of claim 11, wherein the extendable elastic cuff of the first wrist opening and the second wrist opening and the extendable elastic cuff of the first ankle opening and the second ankle opening are constructed from a jersey knit fabric.

13. The swimsuit system of claim 11, wherein the lower-body garment further comprises a waistband, and wherein the waistband includes a pocket located on a back side of the waistband.

14. The swimsuit system of claim 10, wherein the at least one vent opening includes a first vent opening located adjacent to where the first long sleeve extends from the torso portion and a second vent opening located adjacent to where the second long sleeve extends from the torso portion.

15. The swimsuit system of claim 10, wherein the head cover comprises a panel of material having a perimeter edge that is affixed to an inner surface of the head cover at a back side of the head cover, the panel of material having a vertically oriented opening configured to receive hair of a wearer.

16. The swimsuit system of claim 10, wherein the extendable elastic cuff of the first wrist opening and the second wrist opening each includes a thumb-receiving hole.

17. The swimsuit system of claim 10, wherein the back side of the bra is formed from a mesh panel that is affixed to the neck opening and to the first sleeve opening and the second sleeve of the torso portion of the upper-body garment.

* * * * *